United States Patent [19]

Wolfrum et al.

[11] Patent Number: 4,983,420

[45] Date of Patent: Jan. 8, 1991

[54] METHOD OF APPLYING A THERMALLY BLACK LAYER TO A HEATING MEMBER FOR AN INDIRECTLY HEATED CATHODE

[75] Inventors: Stefan M. Wolfrum, Uden; Johannes J. Ponjée; Angela C. L. Van de Poel, both of Eindhoven, all of Netherlands

[73] Assignee: U.S. Philips Corporation, New York, N.Y.

[21] Appl. No.: 410,396

[22] Filed: Sep. 20, 1989

[30] Foreign Application Priority Data

Sep. 29, 1988 [NL] Netherlands ..... 8802387

[51] Int. Cl.[5] ..... B05D 5/12; B05D 7/14; H01J 1/20

[52] U.S. Cl. ..... 427/77; 427/126.4; 427/111; 427/190; 427/191; 427/201; 427/216; 427/220; 427/221; 427/376.2; 427/376.3; 313/337

[58] Field of Search ..... 427/71, 111, 190, 191, 427/201, 216, 220, 221, 376.2, 376.3, 77, 78, 419.2, 126.4; 313/337

[56] References Cited

U.S. PATENT DOCUMENTS

| | | | |
|---|---|---|---|
| 3,016,311 | 1/1962 | Stackhouse | 427/190 |
| 3,075,066 | 1/1963 | Yenni et al. | 427/191 |
| 3,102,044 | 8/1963 | Joseph | 427/190 |
| 3,770,601 | 11/1973 | Maan et al. | 204/181.5 |

FOREIGN PATENT DOCUMENTS

| | | | |
|---|---|---|---|
| 4424744 | 12/1966 | Japan | 427/216 |

*Primary Examiner*—Norman Morgenstern
*Assistant Examiner*—Margaret Bueker
*Attorney, Agent, or Firm*—John C. Fox

[57] ABSTRACT

A filament for an indirectly heated cathode is coated with a tungsten-aluminium oxide suspension, the tungsten particles being stabilized by a chemisorbed monomolecular layer of an aliphatic monocarboxylic acid such as stearic acid.

3 Claims, 1 Drawing Sheet

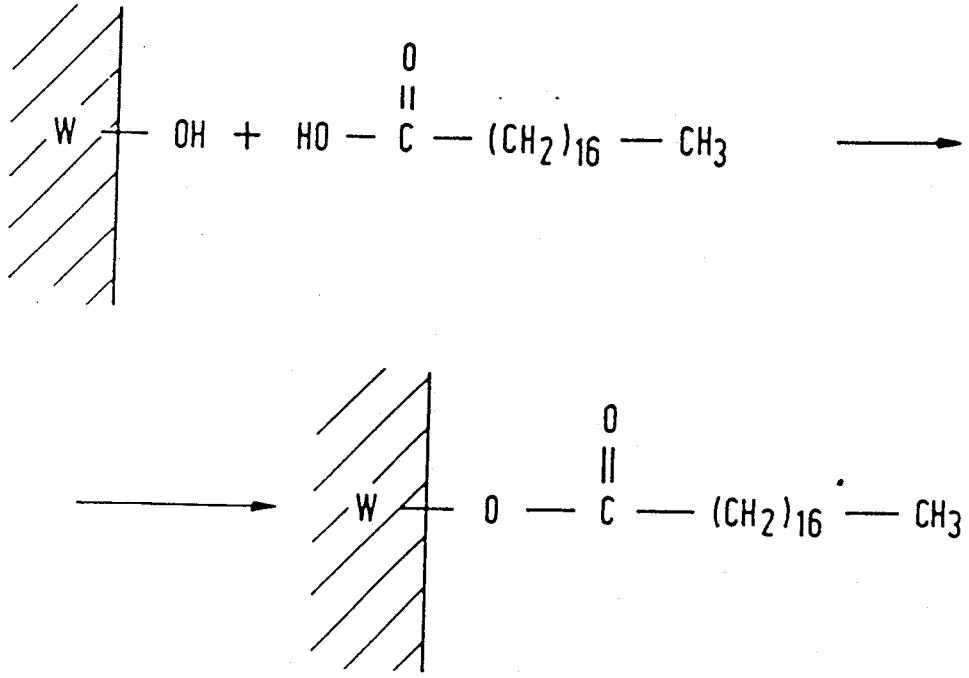
W
OH
+
HO
C
O
(CH2)16
CH3
W
O
C
O
(CH2)16
CH3

METHOD OF APPLYING A THERMALLY BLACK LAYER TO A HEATING MEMBER FOR AN INDIRECTLY HEATED CATHODE

BACKGROUND OF THE INVENTION

The invention relates to a method of applying a thermally black layer to a heating member for an indirectly heated cathode, in which a layer of a suspension of tungsten particles and aluminium oxide particles is provided on the heating member, after which this layer is sintered thereby forming the thermally black layer.

Indirectly heated cathodes are used in, amongst others, cathode ray tubes such as display tubes. Such an indirectly heated cathode comprises a cylindrical member having an electron emitting outer surface and containing in its interior a heating or incandescent member. In general, the heating member is a spiral-shaped tungsten wire which is coated with an electrically insulating aluminium oxide layer. This layer is coated with a black layer to enlarge the heat-radiation from the wire to the cathode, thereby decreasing the warm-up time of the cathode. To this end, the wire is immersed in a suspension of tungsten particles and aluminum oxide particles and after it has been removed it is dried and sintered at a temperature of 1650° C. The black layer obtained is a satisfactory heat radiator.

Such a method is known from U.S. Pat. No. 3,770,601. A disadvantage of the known method is that the suspension used is unstable even if it is stirred. The heavy tungsten particles (specific gravity = 19 g/cm$^3$) coagulate and settle. As a result of this the suspension becomes rich in aluminium oxide particles, such that the tungsten/aluminium oxide ratio in the black layer is no longer correct. Moreover, the pipes of the commonly used circulation system of the coating device become clogged.

OBJECT AND SUMMARY OF THE INVENTION

One of the objects of the invention is to provide a method of the type mentioned in the opening paragraph, which obviates the above-described drawbacks.

This object is achieved in accordance with the invention by a method as described in the opening paragraph, which is characterized in that the suspension is prepared using tungsten particles which are provided with a chemically bonded monomolecular layer of an aliphatic monocarboxylic acid. Coagulation is caused by the mutual attractive force of the particles. This attractive force is caused by Van der Waal's forces and the formation of hydrogen bridges between hydroxyl groups at the surface of different metal particles. The attractive force between the tungsten particles is reduced by making the surface of the tungsten particles react with an aliphatic mono carboxylic acid. The chemical reaction takes place between the carboxyl groups of carboxylic acid molecules and the hydroxyl groups of the surface of a tungsten particle, thereby forming a monomolecular layer of tungsten carboxylate on the tungsten particle. Due to steric hindrance the aliphatic chains of the carboxylic acid molecules bring about a mutual rejection of the tungsten particles. The formation of hydrogen bridges between the hydroxyl groups is prevented because the hydroxyl groups have reacted with the carboxylic acid. Owing to the surface reaction with the carboxylic acid the tungsten particles have become apolar. As a result of this the mutual attractive force between the tungsten particles is substantially reduced and the tendency to coagulation and sedimentation is minimal. During the sintering process which is carried out after the suspension has been applied to the heating member, the carboxylic acid chain is readily burnt in an oxidizing atmosphere such that no chain remains. The tungsten powder thus treated can be dried and stored and, when desired, suspended in a suitable suspension agent such as, for example, methylisobutylketone, together with the untreated aluminium oxide powder. Ultrasonic treatments do not have a negative effect on the dispersive character of the tungsten powder. Suspensions manufactured by means of the treated tungsten powder remain stable for days. Since only a monomolecular layer of the carboxylic acid is chemically bonded the quantities of carboxylic acid used are minimal. The solution of the carboxylic acid used can be recycled and used many times before the carboxylic acid has to be replenished. The aliphatic chain of the carboxylic acid may be both saturated and unsaturated and branched as well as unbranched. The H atoms of the aliphatic chain may be sustituted by one or more apolar groups such as, for example, halogen atoms.

A preferred embodiment of the method in accordance with the invention is characterized in that the aliphatic monocarboxylic acid comprises at least 10 carbon atoms. The general formula of a saturated aliphatic monocarboxylic acid is: $CH_3(CH_2)_nCOOH$. In accordance with the preferred embodiment the value of n is at least 8. Examples of suitable acids are those wherein n = 8 (decanoic acid), n = 9 (undecanoic acid), n = 14 (palmitic acid), n = 16 (octadecanoic acid or stearic acid), n = 20 (docosanoic acid) and n = 28 (triacontanoic acid). A long aliphatic chain has the advantage of a strong steric hindrance. A suitable unsaturated aliphatic monocarboxylic acid is, for example, 9-octadecynoic or oleic acid).

An embodiment of the method in accordance with the invention is characterized in that stearic acid is used as the aliphatic monocarboxylic acid. Stearic acid or octadecanoic acid $CH_3(CH_2)_{16}COOH$ is a cheap readily attainable non-toxic acid which can advantageously be used in the method in accordance with the invention.

BRIEF DESCRIPTION OF THE DRAWING

The invention will now be explained in greater detail by means of the following example and with reference to the accompanying drawing, in which the FIGURE diagrammatically represents the formation of a monomolecular layer of stearic acid on tungsten.

EXAMPLE 68 g of stearic acid is dissolved in 2.3 liters of toluene. 795 g of tungsten powder (manufactured by Starck, type HC 70, average particle size 1.5–3 μm) is added to the toluene. Subsequently, this mixture is refluxed for 4 hours. During this treatment a chemical reaction takes place between the hydroxyl groups on the tungsten surface and the carboxyl groups of the stearic acid, thereby forming a monomolecular layer of tungsten stearate (see drawing).

795 g of this pretreated tungsten powder and 530 g of aluminium oxide powder (average particle size 3 μm) are suspended in 2.2 liters of a 9% by weight solution of cellulose nitrate in methylisobutylketone. For this purpose, the powder-liquid mixture is ground in a ball mill for 18 hours. The suspension thus obtained remains stable and homogeneous for several days.

A tungsten filament provided with a 70 μm thick alundum layer is immersed in the suspension. After removing and drying, a 5 μm thick black layer remains on the filament. This layer is sintered at 1650° C. The layer formed is free from cracks and flakes. Since the suspension remains homogeneous for a long time, the composition of the black layer also remains constant for a long time. The risk that the pipes of the coating arrangement will become clogged is significantly reduced.

We claim:

1. A method of applying a thermally black layer to a heating member for an indirectly heated cathode, in which a single layer of a liquid suspension comprising tungsten particles and aluminium oxide particles is applied to the heating member, after which this layer is sintered, thereby forming the thermally black layer, characterized in that the tungsten particles are provided with a chemically bonded monomolecular layer of an aliphatic monocarboxylic acid prior to preparation of the suspension.

2. A method as claimed in claim 1, characterized in that the aliphatic monocarboxylic acid comprises at least 10 carbon atoms.

3. A method as claimed in claim 2, characterized in that stearic acid is used as the aliphatic monocarboxylic acid.

* * * * *